United States Patent [19]

Prain et al.

[11] 4,335,826

[45] Jun. 22, 1982

[54] RELEASE DEVICE FOR A CONTAINER

[76] Inventors: Henry M. Prain, 27, Steeles Rd., London NW3; Andrew M. Scott, Holmfield, Rollestone Rd., Shrewton, Salisbury, Wiltshire, both of England

[21] Appl. No.: 205,961

[22] PCT Filed: Jan. 9, 1980

[86] PCT No.: PCT/GB80/00005

§ 371 Date: Aug. 26, 1980

§ 102(e) Date: Aug. 26, 1980

[87] PCT Pub. No.: WO80/01375

PCT Pub. Date: Jul. 10, 1980

[30] Foreign Application Priority Data

Jan. 9, 1979 [GB] United Kingdom ..... 7900708

[51] Int. Cl.[3] ..... B65D 17/50; B65D 41/02

[52] U.S. Cl. ..... 220/260; 220/281; 220/315

[58] Field of Search ..... 220/306, 281, 307, 315, 220/323, 260; 9/8 R

[56] References Cited

U.S. PATENT DOCUMENTS 3,220,600 11/1965 Wojciechowski et al. ..... 220/281

*Primary Examiner*—George T. Hall

*Attorney, Agent, or Firm*—Wells & Wells

[57] ABSTRACT

A container 10 has a release device which comprises a flexible plate 14 and a line 17 attached to the contents 11 of the container; when a force is applied to line 17 it is communicated to plate 14 which flexes and is pulled clear of a retaining flange 13 to release contents 11. As shown, the force is applied to the plate 14 via washers 18,19 and 20. Plate 14 preferably has radially directed fingers. The container may constitute part of a rocket-launched projectile and may be used to release a parachute at a desired height, the other end of line 17 being fixed.

7 Claims, 4 Drawing Figures

RELEASE DEVICE FOR A CONTAINER

TECHNICAL FIELD

The present invention relates to release devices for containers and more particularly to devices for use in releasing the contents of a rocket-propelled projectile at a pre-determined height. It is of particular value in procuring the release of a parachute from a housing therefor fired by a rocket to a required height.

When a projectile is fired upwardly by a rocket any loose contents are pressed against the base during acceleration and this base must therefore be designed to withstand such pressure. However if the contents are subsequently to be released from the projectile the base must be designed to give way at the appropriate point.

DISCLOSURE OF THE INVENTION

The present invention relates to a container having a release device comprising a closure member, the container having an aperture therein at the edge of which is provided retaining means and the closure member being arranged to be retained by the said retaining means to obstruct said aperture.

It is characterised in that the closure member is resilient and that upon the application of a predetermined force to a central region of the closure member, flexure of the closure member occurs and it separates from said aperture.

The closure member is preferably in the form of a resilient plate having a plurality of radially directed fingers, e.g. a spider plate.

The container may be part of a rocket-launched projectile and may be used to deploy a parachute at a predetermined height. In this case a flying line is used to apply said force to pull the contents out of the container. This occurs when the line has become fully extended following launch, the other end of the line being held at the point of launch.

BRIEF DESCRIPTION OF DRAWINGS

A preferred embodiment of the present invention will now be described by way of example only with reference to the drawings of which.

BEST MODE OF CARRYING OUT THE INVENTION

Figure 1:
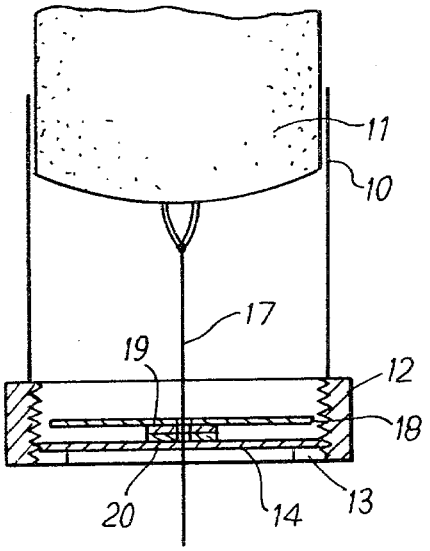
FIG. 1 is a cross-sectional view of part of a container in accordance with the present invention containing a parachute and having a release device.

Referring now to FIG. 1 there is shown a canister 10 containing a parachute pack 11. At the base end of the canister there is provided a collar 12 which has a threaded internal surface. A base ring 13 is retained by the collar 12, the base ring forming an inwardly extending flange defining an opening for subsequent release of the parachute.

Figure 2:
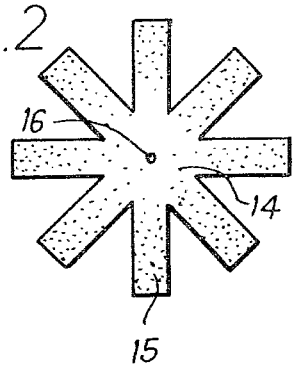
FIG. 2 is a plan view of a closure member in the form of a "spider plate" forming part of the arrangement shown in FIG. 1.
Figure 3:
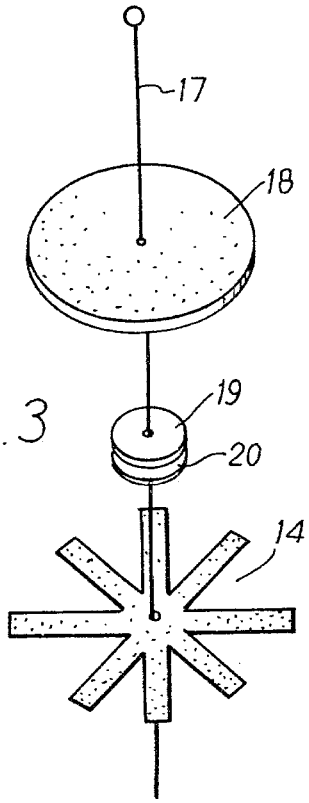
FIG. 3 is an exploded view of the parts of the release device of the arrangement shown in FIG. 1.

A closure member in the form of a foliate-shaped plate 14 is retained by the flange. The plate is made of a resilient material such as steel. As may be seen from FIG. 2. plate 14 has the form of a "spider plate" with eight "fingers" 15. The centre of this plate has an aperture 16 through which the parachute rip cord 17 is threaded. Line 17 is made fast to the shrouding lines of the parachute contained in the canister 14. Also threaded on line 17 are a "G" washer or shim 18 and two pressure washers 19, 20 the washers 19, 20 being positioned between washer 18 and spider plate 14. Washer 18 is of such a size as to cover all parts of the spider plate 14 within the area of the opening in base ring 13 and preferably also extends within the base ring to cover at least a portion of each finger 15 over the upper surface of the base ring. Washer 18 may be of cardboard material and is preferably circular.

Of washers 19,20 the diameter of washer 20 at least is preferably no more than half that of the opening in base ring 13. Preferably this diameter is between a tenth and a third of that of the opening in the base ring. The washers 19, 20 are arranged to bear on the centre of spider plate 14 and to concentrate thereon the pull of the flying line 17 when it has reached the full length of its flight.

In use the parachute, which may be an ascending parachute, is loaded into canister 10 and the flying line or support line 17 is made fast to the shrouding lines of the parachute. The length of line required to deploy the parachute is coiled in a container and made fast to some kind of anchor. The loaded canister is connected with and propelled by one or more rocket motors in known manner. The rocket motors themselves, may be of conventional patterns and will be selected by reference to the weight of the loaded canister and of the line to be carried and to the height at which the load is to be released. When the rocket motors are fired, the parachute within its container is lifted clear of the ground. At the moment of ignition and lift off, the parachute is forced down on to the release device and the load is transferred to the fingers 15 of the plate 14. The "G" washer or shim 18 spreads the load to the outer perimeter of the plate 14, thus preventing the parachute pack 11 from being pushed downwards out of canister 10. It will be noted that the plate 14 is sufficiently flexible to allow the fingers 15 to spread and become locked in the retaining means constituted by the flange of base ring 13.

When line 17 reaches its full extent corresponding to the height at which it is desired to release the parachute, there is a snatch on the line.

Figure 4:
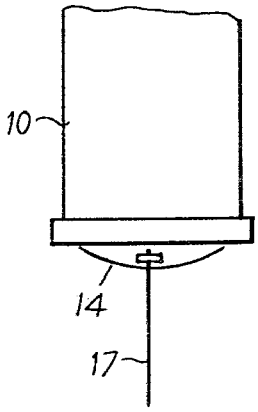
FIG. 4 is a diagrammatic view of the container of FIG. 1 when the closure member of the release device is about to separate from the container.

The impact of this snatch on the line is taken up on the washers 18, 19, 20 which in turn convey the pressure to the centre of the spider plate, and cause the fingers 15 of the plate to be released from their retention in the collar 12. The spider plate 14 assumes a concave attitude, see FIG. 4, and is thus reduced in effective diameter. Although the washer 18 is sufficiently stiff to spread the force of the load 11 over the spider plate 14 during launch of the rocket, it readily buckles or collapses to permit its removal from collar 12 when the snatch on the line occurs. Under the momentum of the rocket launcher, the canister 10 continues its flight and the parachute is snatched out of the canister and deploys in the air stream in the atmosphere.

The flying line which holds the parachute in flight (in the case of an ascending parachute) is made fast to a lanyard used to activate the release mechanism of the parachute.

Although in the above-described embodiment the plate 14 had eight fingers this number is not critical and any number from two upwards may be used depending on the particular physical requirements and the precise design adopted, though preferably there are at least three. The width of the fingers 15 need not be constant over their length. The thickness and resiliency of the material from which the fingers are made, and their lengths and the proportion of the opening of the base ring 13 occupied by the solid central portion of the spider plate may all be varied to suit particular requirements, e.g. the weight of the load and the thrust provided by the rockets therefore, and the size of the opening of the canister collar.

Although two pressure washers 19,20 are provided in the above-described embodiment there may be only one such washer; alternatively there may be more than two washers.

The container of the present invention may be used to release loads other than parachute packs. With appropriate modifications, loads having wide ranges of weight and/or dimensions may be carried.

It will be understood that the above description of the present invention is susceptible to various further modifications, changes and adaptions.

Industrial Applicability

The container may be used to release a desired load at a desired point. If the load includes a parachute, this is used to carry airbourne detecting and measuring equipment, for example.

We claim:

1. A container having a release device comprising a resilient closure member and a line, the line being attached to contents of the container and passing through said closure member, the container having an aperture therein at the edge of which is provided retaining means, and the closure member being arranged to be retained by said retaining means to obstruct said aperture, wherein upon the application by said line of a predetermined force to a central region of the closure member, the closure member is caused to flex by the contents and separates from said aperature.

2. A container according to claim 1, wherein the closure member is a resilient plate which has a plurality of fingers arranged to engage said retaining means.

3. A container according to claim 1 or 2, wherein the retaining means is constituted by a flange extending around the periphery of said aperture.

4. A container according to claim 1, wherein one or more washers are provided between said closure member and said contents, the line passing through said washer(s).

5. A container according to claim 4, wherein the washer, or a first one of the washers, is of substantially the same size as the closure member, and the closure member is arranged between said washer and the retaining means.

6. A container according to claim 5, wherein at least one second washer is provided between the first washer and the closure member, the second washer being substantially smaller than the closure member.

7. A container according to claim 1, wherein the container is part of a rocket-launched projectile and one end of said line is attached to contents of the container, the other end of the line being arranged to be attached to a fixed point, and the line having a length corresponding to a desired height at which it is desired to release the contents of the container.

* * * * *